US006042400A

United States Patent [19]

Queffelec et al.

[11] Patent Number: 6,042,400

[45] **Date of Patent: *Mar. 28, 2000**

[54] POWER SUPPLY HOUSING WITH FOLDABLE BLADES

[75] Inventors: John A. Queffelec, Carol Stream; Craig M. Cors, Aurora; Francis J. Saliga, Berwyn, all of Ill.

[73] Assignee: International Components Corp., Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/143,085

[22] Filed: Aug. 28, 1998

Related U.S. Application Data

[63] Continuation-in-part of application No. 29/092,723, Aug. 25, 1998.

[51] Int. Cl.[7] ..... H01R 13/44

[52] U.S. Cl. ..... 439/131; 439/172

[58] Field of Search ..... 439/131, 171, 439/172, 173, 174, 521

[56] References Cited

U.S. PATENT DOCUMENTS

| | | | |
|---|---|---|---|
| D. 339,563 | 9/1993 | Usami | D13/107 |
| D. 350,113 | 8/1994 | Nagele | D13/110 |
| 3,079,475 | 2/1963 | Rumble | 200/512 |
| 3,996,546 | 12/1976 | Hugly | 336/107 |
| 4,543,624 | 9/1985 | Rumble | 363/146 |
| 4,815,983 | 3/1989 | Erickson et al. | 439/173 |
| 4,973,827 | 11/1990 | Nozaki | 219/521 |
| 4,997,381 | 3/1991 | Oh | 439/172 |
| 5,159,545 | 10/1992 | Lee | 363/146 |
| 5,423,690 | 6/1995 | Selker et al. | 439/172 |
| 5,474,464 | 12/1995 | Drewnicki | 439/172 |
| 5,494,449 | 2/1996 | Chioo | 439/131 |
| 5,540,596 | 7/1996 | Bothe et al. | 439/172 |
| 5,611,701 | 3/1997 | Hahn | 439/131 |
| 5,613,863 | 3/1997 | Klaus et al. | 439/131 |
| 5,616,051 | 4/1997 | Rogers et al. | 439/518 |
| 5,628,641 | 5/1997 | Hahn | 439/131 |
| 5,634,806 | 6/1997 | Hahn | 439/173 |
| 5,648,712 | 7/1997 | Hahn | 320/111 |
| 5,684,689 | 11/1997 | Hahn | 363/146 |

*Primary Examiner*—Renee S. Luebke
*Assistant Examiner*—T C Patel
*Attorney, Agent, or Firm*—Fitch, Even, Tabin & Flannery

[57] ABSTRACT

A power supply housing with folding rotatable mounted blades adapted to rotate between a retracted position and an extended position. In a retracted position, the blades are adapted to be plugged into various receptacle adapters for use with receptacle configurations outside of North America. In an extended position, the rotatable blades are adapted to be plugged into a standard receptacle. A rotatable barrier is provided which prevents accidental contact with the blades when the blades are plugged into a standard receptacle, thereby enabling the power supply housing to meet industry standards.

13 Claims, 6 Drawing Sheets

POWER SUPPLY HOUSING WITH FOLDABLE BLADES

CROSS-REFERENCE TO RELATED APPLICATIONS

This application is a continuation in part of copending patent application, Ser. No. 29/092,732, filed on Aug. 25, 1998 entitled, "Folded Blade Housing" by John A. Queffelec, Craig M. Cors and Francis J. Saliga.

BACKGROUND OF THE INVENTION

1. Field of the Invention

The present invention relates to a power supply housing, and more particularly to a power supply housing with folding blades rotatable between an extended position and a retracted position which includes a barrier to prevent accidental contact with the blades when the blades are extended and plugged into a standard receptacle and is configured to enable the blades to be plugged into various receptacle adapters for different receptacle configurations when the blades are in a retracted position.

2. Description of the Prior Art

Various power supply housings are known which include foldable blades rotatably mounted between a retracted position and an extended position. In the extended position, the blades are adapted to be plugged into a standard receptacle. Examples of such power supply housings are disclosed in U.S. Pat. Nos. 5,613,863 and 5,616,051. In both of the above-mentioned patents the blades are adapted to be plugged into various receptacle adapters when the blades are in a retracted position. The receptacle adapters enable the power supply housing to be used in different applications having different receptacle configurations. More particularly, in an extended configuration, the blades are configured for North American standard receptacles and are adapted to be plugged thereinto. In a retracted position, the folded blades are adapted to plug into adapters for different receptacle configurations for use outside of North America.

The receptacle adapters provide various benefits to both manufacturers and users. From a manufacturer's standpoint, only one housing needs to be fabricated for all applications irrespective of the receptacle configuration. As such, the part count and thus, the cost of manufacturing the power supply housings is significantly reduced for manufacturers who supply power supply housings in global markets. From an end user's standpoint, the receptacle adapters enable travelers to utilize their power supplies in geographic regions having different receptacle configurations.

Unfortunately, there is one major drawback with such power supply housings. In particular, various industry standards agencies require that the power supply housings be configured to prevent inadvertent or accidental contact with the blades when the power supply housing is plugged into a standard receptacle. For example, Underwriters Laboratory standard UL 1310, dated Jul. 7, 1995 and Canadian Standards Association standard CAN/CSA-C22.2 No. 223-M91, June, 1991 require about 8 mm spacing between the blades and any live potential contact points. Unfortunately, the housing configurations disclosed the above-mentioned patents do not satisfy such requirements. Thus, there is a need to provide a power supply housing with folding blades that is configured to prevent accidental contact with the blades when the blades are plugged into an extended position and plugged into a standard receptacle and enables the blades to be plugged into receptacle adapter in a retracted position.

SUMMARY OF THE INVENTION

Briefly, the present invention relates to a power supply housing with folding rotatable mounted blades adapted to rotate between a retracted position and an extended position. In a retracted position, the blades are adapted to be plugged into various receptacle adapters for use with receptacle configurations outside of North America. In an extended position, the rotatable blades are adapted to be plugged into a standard receptacle. A rotatable barrier is provided which prevents accidental contact with the blades when the blades are plugged into a standard receptacle, thereby enabling the power supply housing to meet industry standards.

BRIEF DESCRIPTION OF THE DRAWINGS

These and other benefits of the present invention will be readily understood with reference to the following specification and attached drawing, wherein.

DETAILED DESCRIPTION OF THE INVENTION

Figure 1:
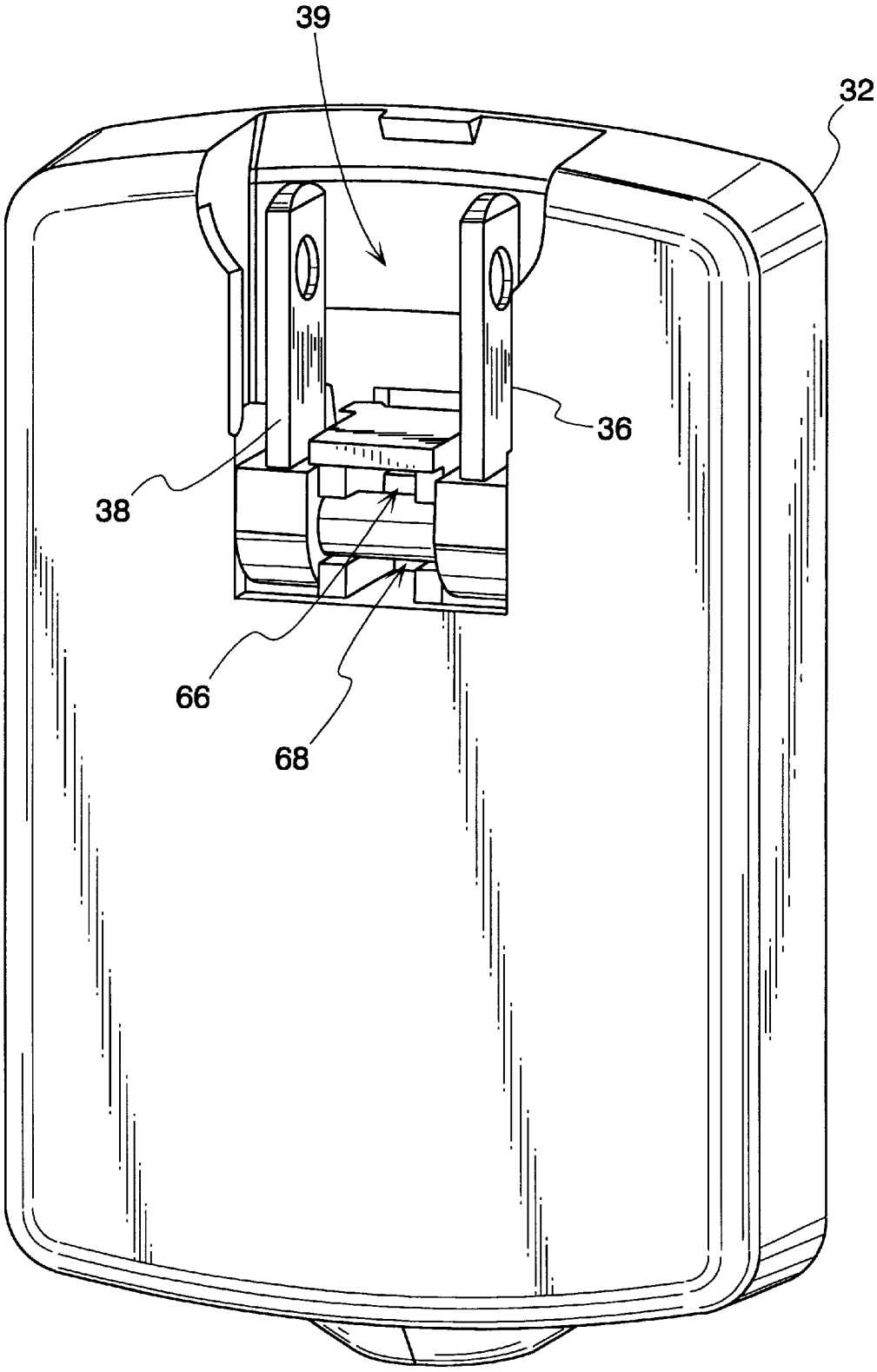
FIG. 1 is perspective drawing of the power supply housing in accordance with the present invention shown with the blades in a retracted position and a rear housing portion removed.
Figure 2:
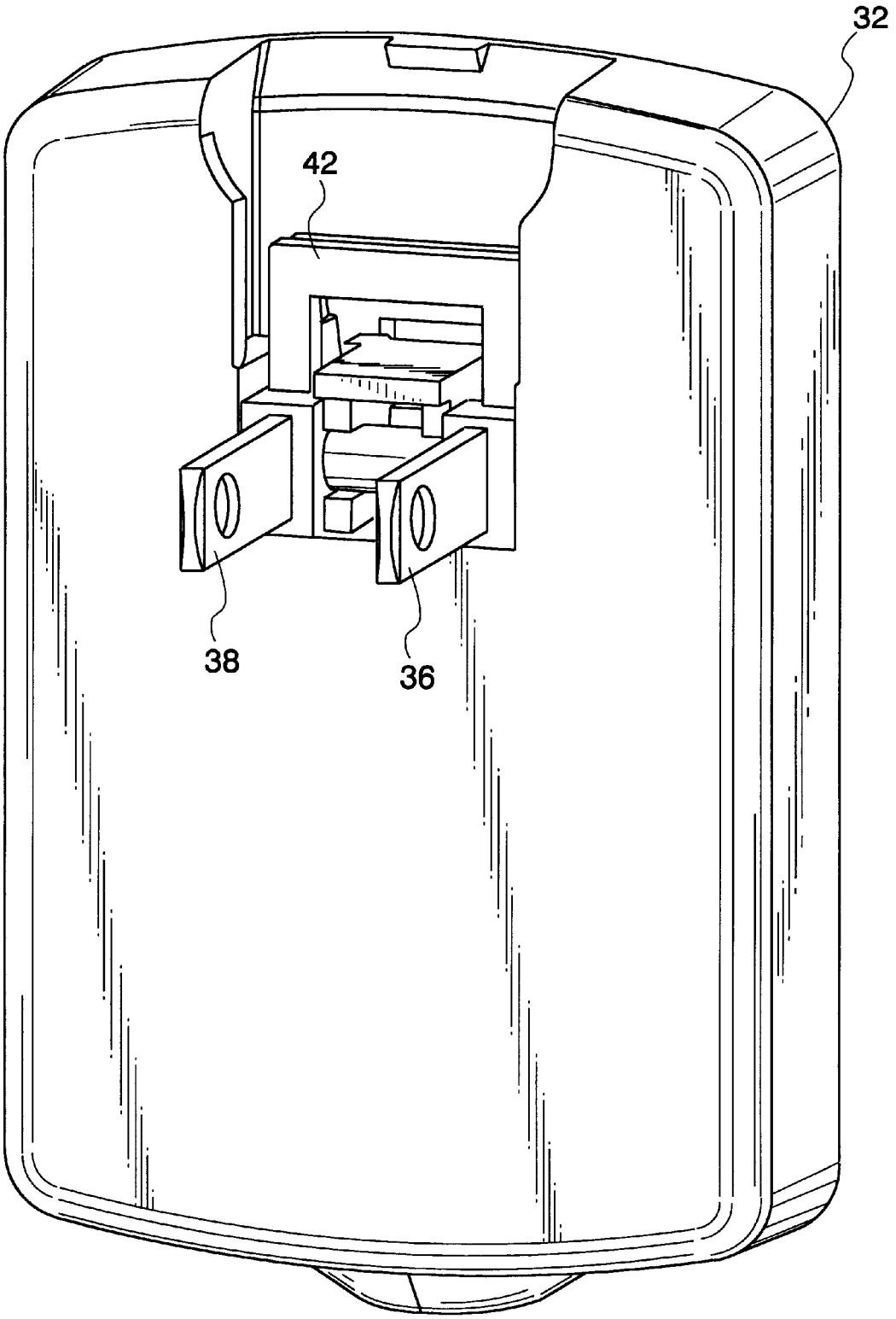
FIG. 2 is a perspective drawing similar to FIG. 1 but with the blades in an extended position.
Figure 8:
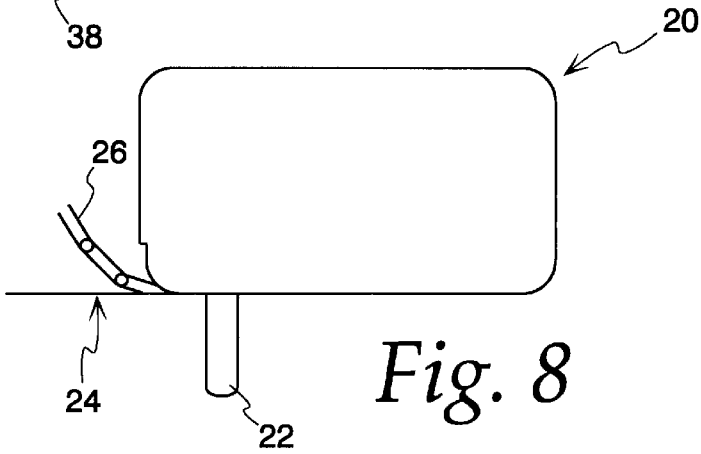
FIG. 8 is a diagram of a power supply housing plugged into a wall receptacle which illustrates the spacing between the blades and any contact points in accordance with Underwriters Laboratory standard UL 1310.

The present invention relates to a power supply housing with folding rotatable blades. The blades are adapted to be rotated between a retracted position as shown in FIG. 1 and an extended position as shown in FIG. 2. In the extended position, the blades are configured for a standard receptacle as used in North America. In a retracted position as shown in FIG. 1, the blades are adapted to be plugged into various receptacle adapters for various receptacle configurations outside of North America, for example, as disclosed in U.S. Pat. Nos. 5,613,863 and 5,616,051, hereby incorporated by reference. An important aspect of the invention relates to the ability of the power supply housing in accordance with present invention to prevent accidental contact with the blades when the blades are plugged into a standard receptacle as shown in FIG. 8. More particularly, various industry standard organizations, such as Underwriters Laboratories (UL) and the Canadian Standard Association (CSA) require a certain amount of clearance between the blades and any contact points when the blades are plugged into a standard receptacle. For example, FIG. 8 illustrates the requirements of Underwriters Laboratories standard UL 1310, dated Jul. 7, 1995. As shown in FIG. 8, an exemplary power supply enclosure, generally identified with the reference numeral 20, includes a pair of extended blades 22. The power supply enclosure 20 is shown plugged into a standard receptacle with the housing 20 disposed in contact with the surface of a wall receptacle, generally identified with the reference numeral 24. An articulated probe 26 is used to determine any contact points with the blade 22. In accordance with the standard, a distance A between the blade and the closest contact point of the articulated probe 26 can be no less than 5/16 inch or 7.9 mm. Similarly, a Canadian Standards Association standard CSA C22.2 No. 223-M91 dated June, 1991, requires that the contact distance may not be less than 8 mm from any point relative to the blade. As will be discussed in more detail below, the power supply housing in accordance with the present invention is able to meet such requirements and at the same time allow the folding blades to be plugged into receptacle adapters.

Figure 3:
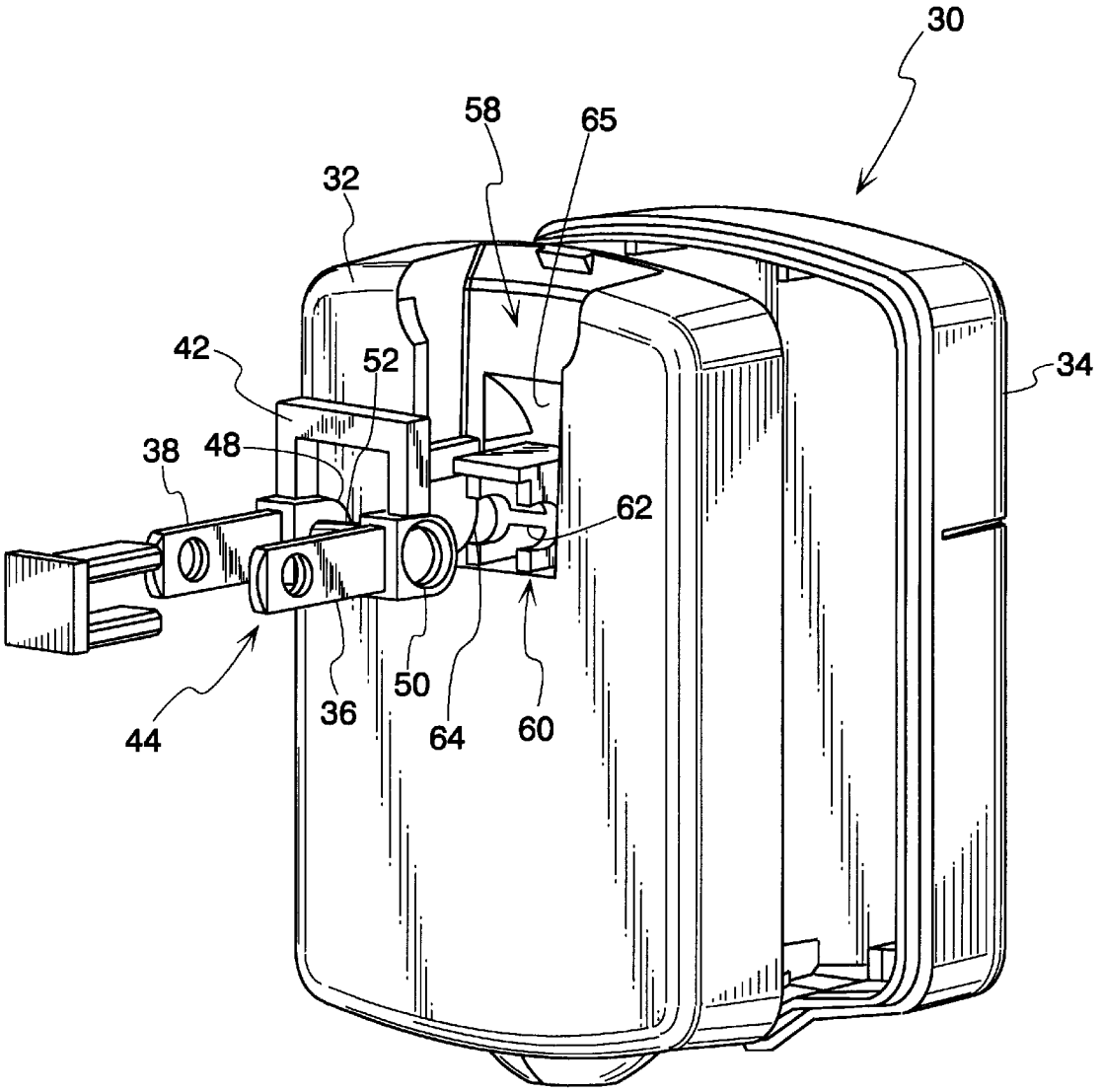
FIG. 3 is a exploded perspective view of the power supply housing in accordance with the present invention shown with the blades in an extended view.
Figure 4:
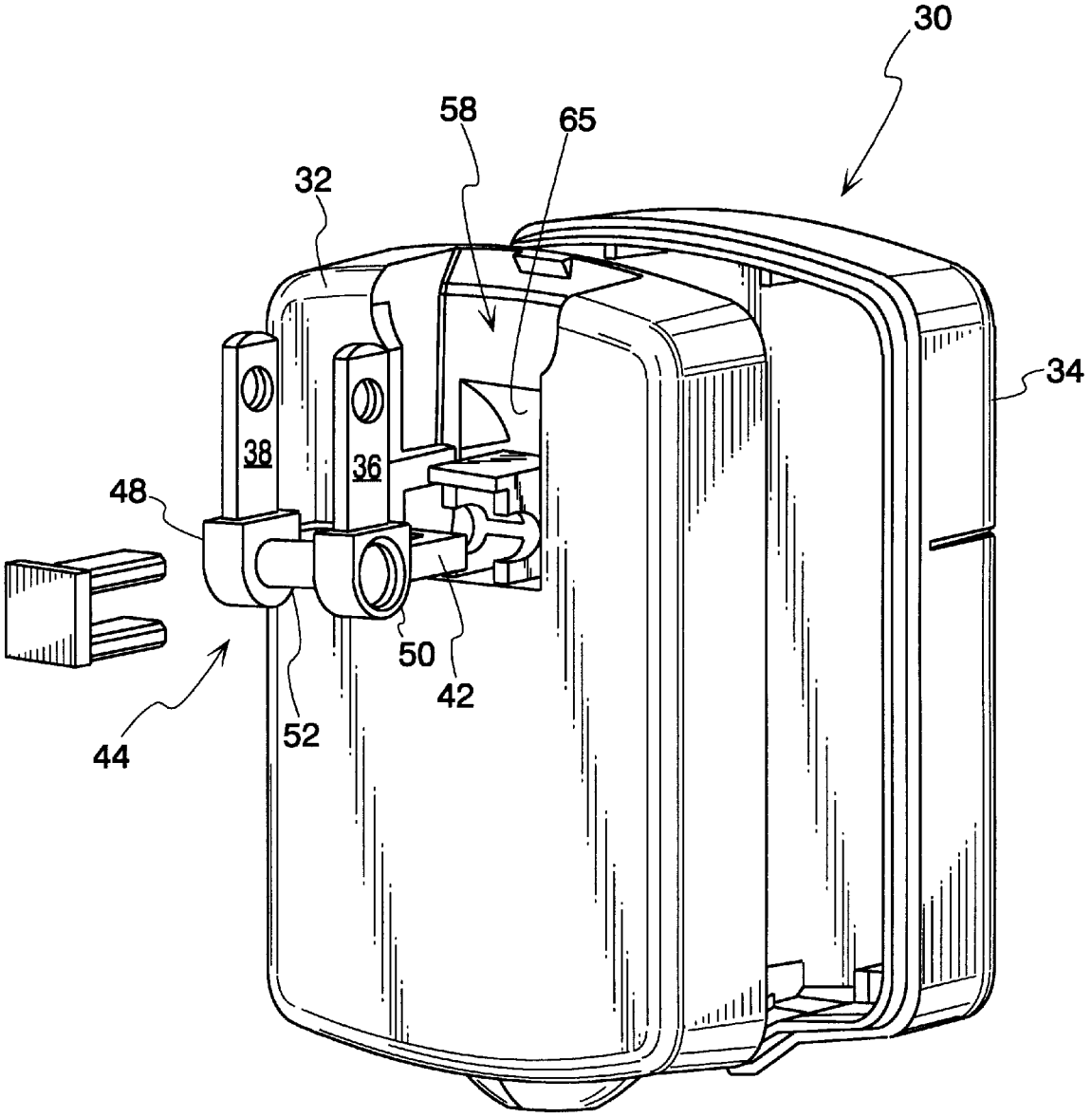
FIG. 4 is similar to FIG. 3 but with the blades shown in a retracted position.

Referring to the drawings and in particular, FIGS. 3 and 4, the power supply housing in accordance with the present invention is generally identified with the reference numeral 30. The power supply housing 30 may be formed as a two part housing including a front housing portion 32 and a rear housing portion 34 formed from a dielectric material, such as molded plastic. Power supply circuitry (not shown), for example, as disclosed in U.S. Pat. No. 5,613,863, hereby incorporated by reference, is adapted to fit within the housing 30 and be connected to a pair of folding blades 36 and 38.

Figure 7:
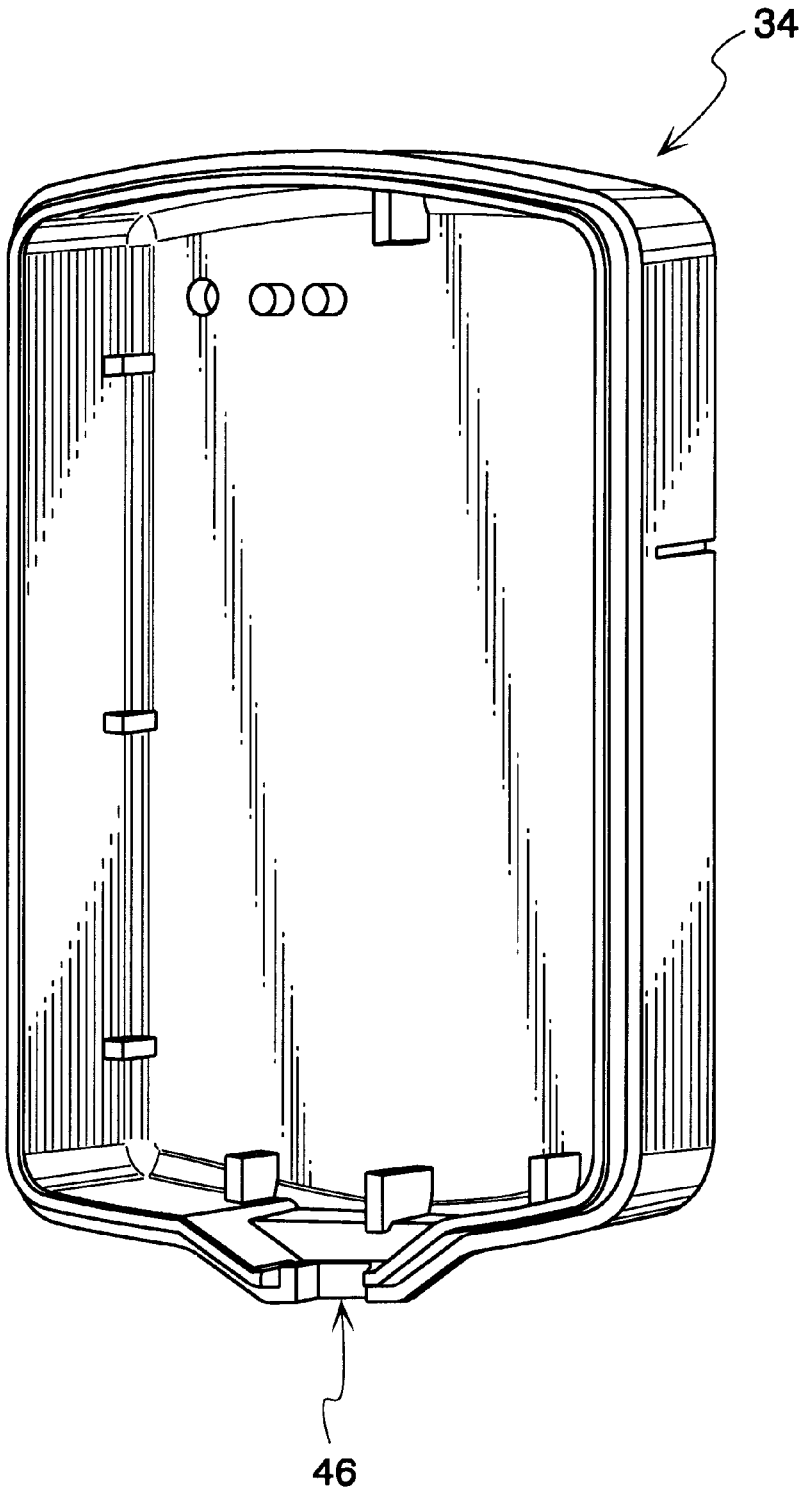
FIG. 7 is a perspective view of the back housing which forms a part of the invention.

The front 32 and rear 34 housing portions are adapted to be assembled together by conventional techniques, such as by an adhesive, snap fit or virtually any means in order to house the power supply circuitry. As shown in FIG. 7, the rear housing portion 34 as well as the front housing portion 32 may be formed with a bottom opening 46 for receiving an electrical conductor (not shown) that is adapted to be plugged into an electrical apparatus, such as a cellular phone or the like.

An important aspect of the invention is the ability to prevent accidental contact with the blades 36, 38 when the power supply housing 30 is plugged into a standard receptacle in order to meet various industrial standards, such as the UL and CSA standards. As will be discussed in more detail below, the housing 30 still maintains clearance, such as the area 39 (FIG. 1) to enable the folding blades 36, 38 to be plugged into various receptacle adapters, for example, as illustrated in U.S. Pat. Nos. 5,616,051 and 5,613,863, hereby incorporated by reference when the blades are in a retracted position. Such accidental contact is prevented by way of a barrier 42 formed as part of the folding blade assembly 44.

Figure 5:
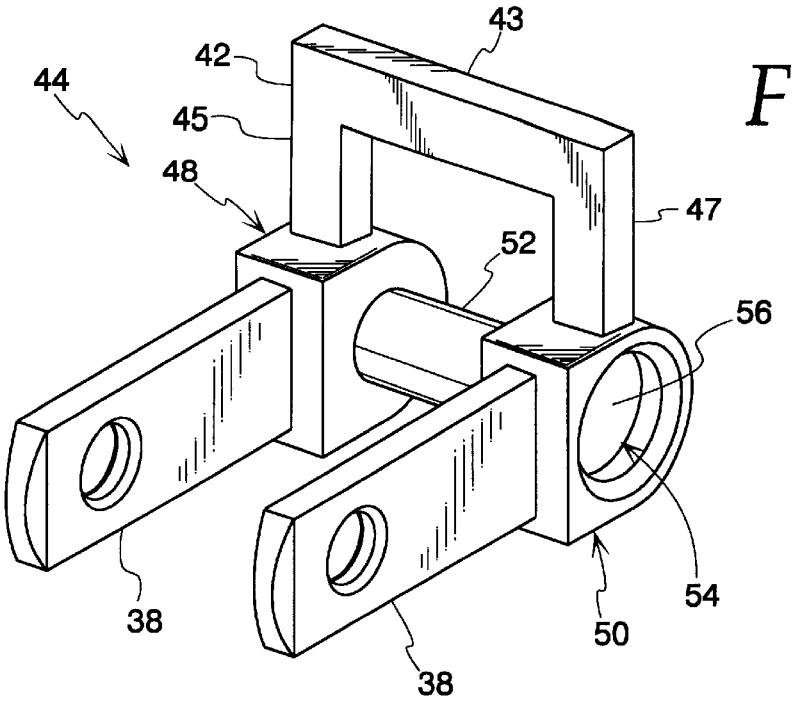
FIG. 5 is a perspective view of a blade assembly in accordance with the present invention.

As shown best in FIG. 5, the folding blade assembly 44 includes the pair of parallel spaced apart blades 36, 38. The blades 36, 38 are carried by a pair of spaced apart end caps 48, 50 rigidly connected together by an axle 52. The blades 36, 38 may be molded in the end caps 48, 50 by conventional molding techniques. The axle 52 as well as the barrier 42 may be integrally molded with the end caps 48, 50. The blades 36, 38 are formed from an electrically conductive material, such as copper or nickel plated brass, while the end caps 48, 50, axle 52 and barrier 42 are formed from a dielectric material, such as molded plastic. The barrier 42 may be formed as a C-shaped member and rigidly connected to the end caps 48, 50 to enable the folding blades 36, 38 to be rotatably mounted and may be integrally molded therewith.

The exemplary barrier 42 is formed from a bridge portion 43 and depending leg positions 45 and 47 (FIG. 5). The barrier 42 is attached to the end caps 48, 50 such that the depending leg positions 45, 47 are generally perpendicular to the longitudinal axis of the blades 36, 38 and the bridge portion 43 is generally parallel to the axle 52. With such a configuration, the plane of the barrier 42 will generally be perpendicular to the plane of the front housing portion 22 when the blades 36, 38 are in a retracted position and generally parallel to the plane of the front housing portion 22 when the blades 36, 38 are in an extended position. The barrier 42 may also be connected to the end caps 48, 50 such that the depending leg portions 45, 47 are other than perpendicular to the longitudinal axis of the blades 36, 38.

An outwardly facing aperture 54 is formed in each of the end caps 48, 50 to expose a rear portion 56 of the each of the folding blades 36, 38. The exposed rear portions 56 of the folding blades 36, 38 enable the folding blades 36, 38 to be electrically connected to electric circuitry within the housing 30 as discussed above. Since the folding blades 36, 38 have a dual function (i.e. in the extracted position as shown in FIG. 2 and the extended position in FIG. 1), continuous electrical connection with the exposed portion 56 of the blades 36, 38 is required. Various conventional methods may be used for providing a continuous electrical connection to the folding blades 36, 38 in both the extended and retracted positions. For example, a length of wire or conductor, such as copper wire, spring copper contact, or a contact arrangement, for example, as disclosed in commonly owned co-pending patent application Ser. No. 08/963,329 filed on Nov. 3, 1997, with or without a detent feature, hereby incorporated by reference, may be electrically connected to the exposed portion 56 of each of the blades 36, 38. All such methods of providing continuous electrical contact with the folding blades 36, 38 are considered to be within the broad scope of the invention.

The apertures 54, formed in the end caps 48, 50, are adapted to disposed beneath the surface of the front housing portion 32 when the folding blade assembly 44 is properly assembled to the front housing portion 32. In particular, a well, generally identified with the reference numeral 58, is formed in the front housing portion 32. The well 58 is formed to receive the folding blades 36, 38 in the retracted position as shown in FIG. 1. An important aspect of the invention is that the barrier 42 is pivoted out the way and into the well 58 in a retracted position as shown in FIG. 1 to provide a clear access area 39 (FIG. 1) to enable the folding blades 36 and 38 to be plugged into various receptacle adapters, for example, as discussed above. However, in the extended position, the barrier 42 prevents any accidental contact within a predetermined distance from the folding blades 36, 38 when the folding blades 36, 38 are plugged into a standard receptacle.

A pair of spaced apart forks 60 is formed within the well 58. The pair of spaced apart forks 60 is formed with a pair of notches 62, 64, adapted to receive the axle 52 of the folding blade assembly 44. The pair of spaced apart forks 60 receives the axle 52 and enables the folding blades 36, 38 to rotate between the extended position illustrated in FIG. 2 and the retracted position as illustrated in FIG. 1.

In order to clear the access area 39 when the blades 36, 38 are in a retracted position, a subwell 65 (FIGS. 3 and 4) may be formed adjacent the well 58 to receive the barrier 42. In the retracted position, the plane of the barrier 42 is essentially perpendicular to the plane of the front housing portion 32. The depth of the subwell 65 must be selected to accommodate the height and width of the barrier 42.

Figure 6:
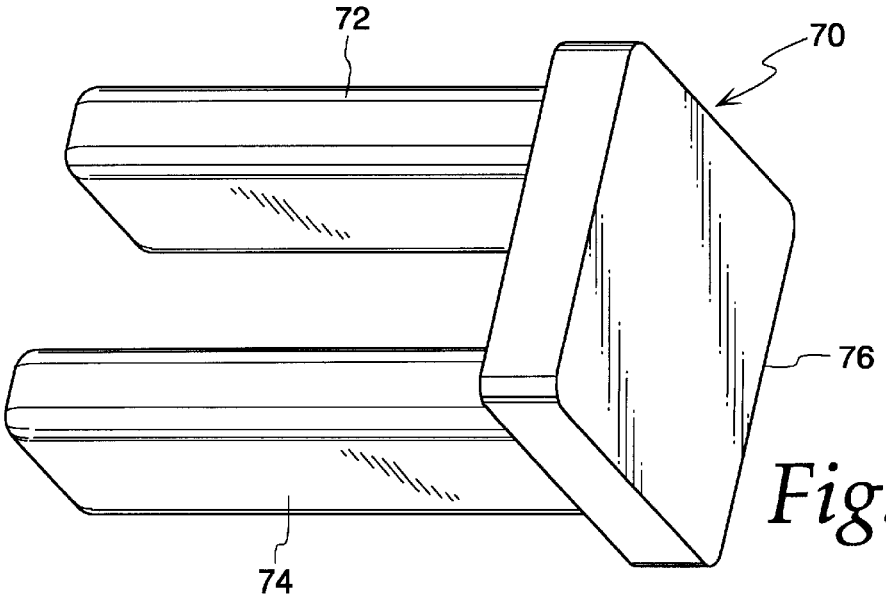
FIG. 6 is a perspective view of a capture element used to capture the blade assembly in accordance with the present invention.

As best shown in FIG. 1, a pair of apertures 66, 68 may be formed in the front housing portion 22 adjacent the spaced apart forks 60. The apertures 66, 68 may used to receive a capture element 70 (FIG. 6). The capture element 70 is formed with a pair of extending legs 72, 74, spaced apart in order to be received in the apertures 66, 68. The depending legs 72, 74 are bridged together by a bridge portion 76. As such, when the legs 72,74 of the capture element 70 are disposed within the aperture 66, 68, the bridge portion 76 captures the axle 52 relative to the front housing portion 32 to enable the folding blade assembly 44 to freely pivot. The depending legs 72, 74 may be heat staked after being received in the apertures 66, 68 in order to secure the capture element 70 relative to the front housing portion 22. Other methods of securing the capture element 70 to the front housing portion 22 are also suitable.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A power supply housing with foldable blades, the power supply housing comprising:

a two piece housing including a front housing portion and a rear housing portion, said front housing portion formed with a well for receiving a pair of rotatable blades, a subwell for receiving a rotatable mounted barrier and an access area;

a blade assembly including a pair of spaced apart blades adapted to be received in a standard receptacle, a pair of end caps and an axle, said blades each mounted on one end to said pair of end caps, said axle for joining said end caps, said blade assembly including a barrier, rigidly mounted relative to said end caps, such that the plane of said barrier is generally perpendicular to the plane of the front housing portion when said blades are in a retracted position, said barrier adapted to be received in a subwell formed adjacent said well when said blades are in said retracted position;

a pair of spaced apart forks formed in said well, formed with circular notches on one end for receiving said axle and enabling said blade assembly to be rotatably mounted relative to said front housing portion from an extended portion to said retracted position wherein said blades are received in said well and disposed clear of said access area; and a capture element for capturing said axle relative to said forks adapted to be rigidly secured to said front housing portion.

2. The power supply housing as recited in claim 1, wherein said barrier is formed in a C-shape defining a bridge portion and a pair of depending legs.

3. The power supply housing as recited in claim 2, wherein said depending legs are rigidly connected to said end caps.

4. The power supply housing as recited in claim 3, wherein said barrier is mounted such that said bridge portion is generally parallel to said axle.

5. The power supply housing as recited in claim 4, wherein said barrier is mounted such that said depending legs are generally perpendicular to the longitudinal axis of such blades.

6. The power supply housing as recited in claim 1, wherein said end caps are formed with outwardly facing apertures for exposing a portion of said blades to enable said blades to be connected to an external circuit.

7. The power supply housing as recited in claim 6, wherein said blades are molded in said end caps.

8. The power supply housing as recited in claim 7, wherein said end caps and said axle are integrally molded.

9. The power supply housing as recited in claim 8, wherein said barrier is integrally molded with said end caps and said axle.

10. The power supply housing as recited in claim 9, wherein said capture element is formed as a c-shaped element with a bridge portion and a pair of depending legs.

11. The power supply housing as recited in claim 10, wherein said front housing portion is formed with a pair of spaced apart apertures for receiving said depending legs of said capture element.

12. The power supply housing as recited in claim 11, wherein said depending legs are adapted to be heat staked to secure said capture element relative to said front housing.

13. The power supply housing as recited in claim 12, wherein said pair of spaced apart apertures are disposed adjacent said forks.

* * * * *